United States Patent [19]

Salzmann

[11] 3,951,196

[45] Apr. 20, 1976

[54] TRAVERSE ROD ASSEMBLY

[75] Inventor: Ferdinand F. Salzmann, Middleton, Wis.

[73] Assignee: Consolidated Foods Corporation, Chicago, Ill.

[22] Filed: May 19, 1975

[21] Appl. No.: 578,920

[52] U.S. Cl. ..... 160/345; 16/87.4 R

[51] Int. Cl.[2] ..... A47H 5/02

[58] Field of Search ....160/344–347, 126, 124, 123; 16/87–87.8, 93D, 94 D

[56] References Cited

UNITED STATES PATENTS

| | | | |
|---|---|---|---|
| 3,434,524 | 3/1969 | Fein | 160/345 |
| 3,460,603 | 8/1969 | Toder | 160/345 |
| 3,503,434 | 3/1970 | Ford | 160/345 |
| 3,522,621 | 8/1970 | Ford et al. | 160/345 X |
| 3,693,696 | 9/1972 | Salzmann | 160/345 |

*Primary Examiner*—Philip C. Kannan
*Attorney, Agent, or Firm*—Morsbach & Pillote

[57] ABSTRACT

A traverse rod including a downwardly opening carrier channel having inwardly extending carrier support rails at its lower edge, a master carrier mounted on the rod for movement parallel to the carrier channel and having master drapery support means thereon, and an intermediate carrier system, including a lead carrier at the end of a flexible string and a plurality of auxiliary carriers at spaced locations along the string each having heads guidably mounted on the rails at the lower end of the channel. The master carrier is constructed and arranged with relation to the rails at the lower edge of the channel so that the lead carrier on the intermediate carrier system can slide along the rails to a preselected position relative to the master drapery support means on the master carrier, and clamp means are provided to engage the lead carrier and master carrier to detachably secure the lead carrier in said preselected position to the master carrier.

10 Claims, 7 Drawing Figures

Fig. 1.
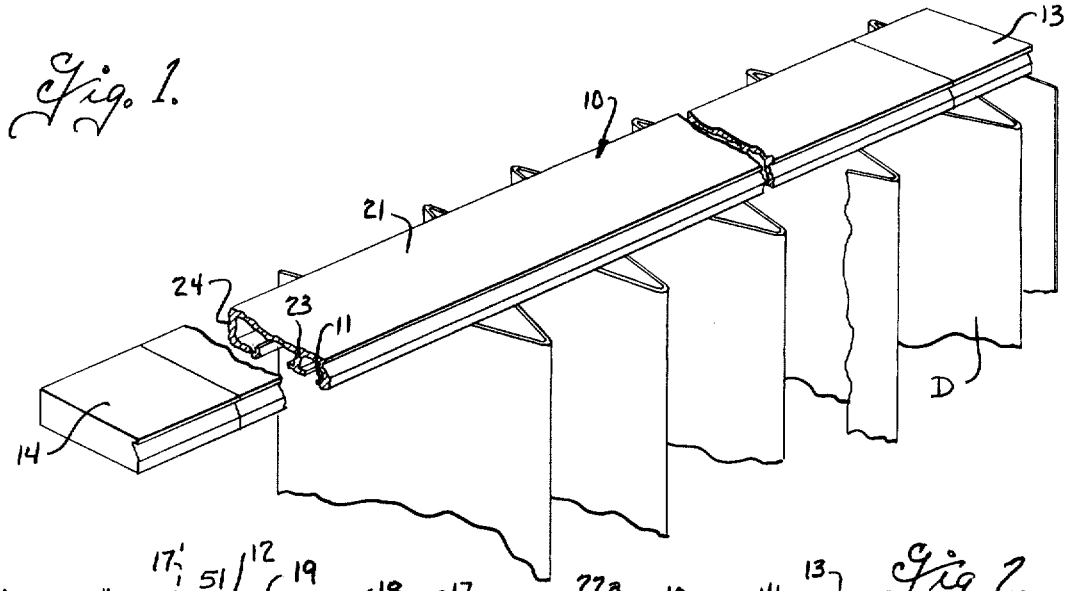
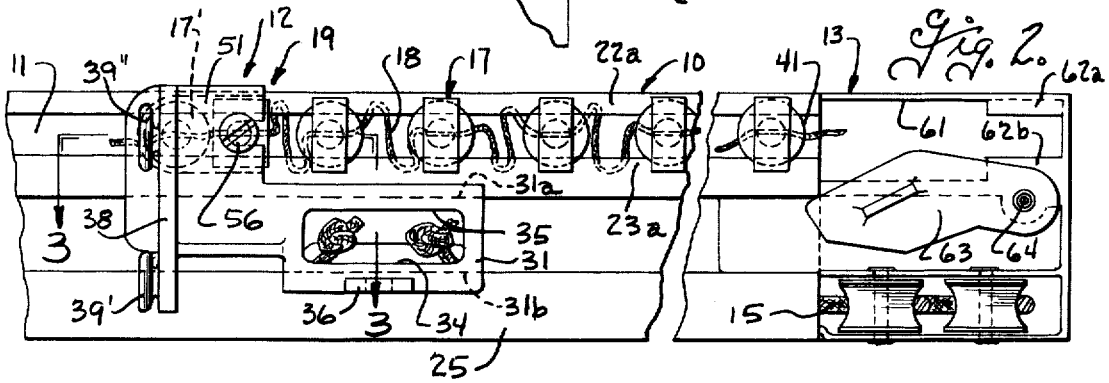
Fig. 2.
Fig. 4.
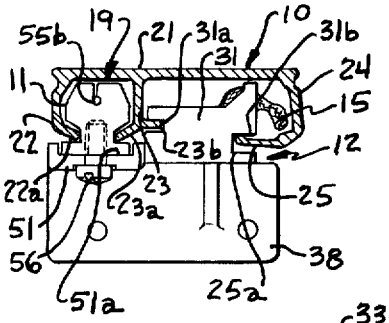
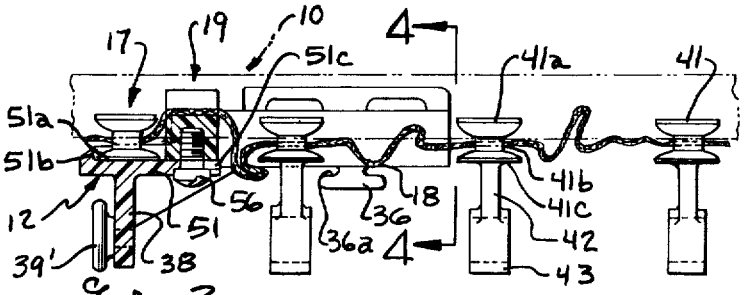
Fig. 3.
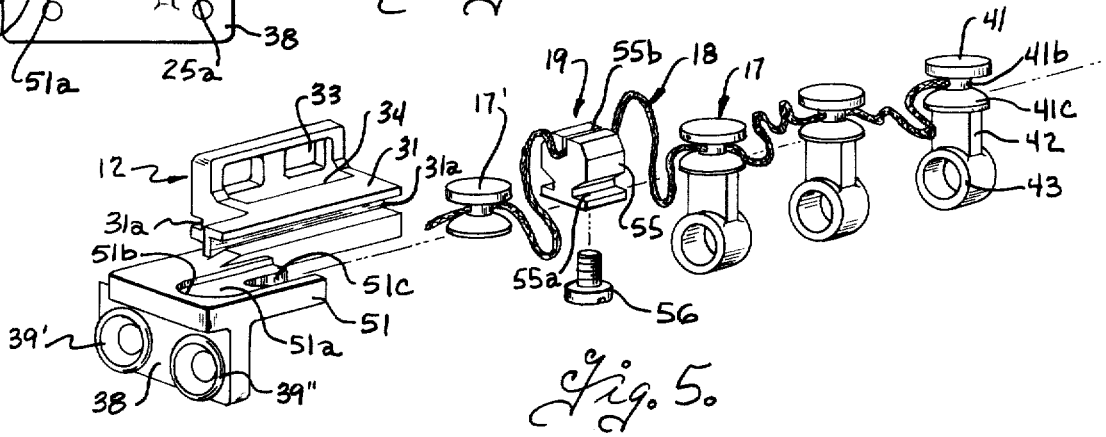
Fig. 5.

TRAVERSE ROD ASSEMBLY

BACKGROUND OF THE INVENTION

Interconnected drapery carrier systems of the type having a plurality of drapery carriers attached at spaced locations along a flexible member are known. The drapery carriers have drapery mounting means thereon adapted for attachment to a drapery at spaced locations along the drapery heading and the lead or spacing between the carriers along the flexible member is selected to be less than the spacing of the carriers along the drapery heading so that the flexible string controls the spacing between the carriers when the drapery is closed to produce generally uniform pleats in the drapery. When such drapery carrier systems are utilized on traverse rods, one end of the string is connected to the master carrier so that the master carrier draws the string of interconnected carriers along the rod when it is moved to a position to close the drapes.

In the traverse rod assembly shown in the applicant's prior U.S. Pat. No. 3,693,696, issued Sept. 26, 1972, it was necessary to connect the carrier at one end of the string of carriers to the master slide before the master slide was mounted on the rod and hence before the rod was installed on the ceiling or wall above a window. However, the interconnected drapery carrier systems are available in strings with different carrier lead or spacing to vary the fullness of the drapery when drawn. The prior traverse rod construction made it necessary to select the desired lead of the drapery carriers prior to installation of the rod and it was not practical to delay this selection until a later date when the draperies were made and installed. In addition, the prior traverse rod construction made it difficult to replace the interconnected carrier system when the string broke or became worn since it was necessary to remove both the stringed carriers and the master carrier from the rod and then attach the end of the stringed carrier to the master carrier and finally reassemble the master carrier on the rod and thread the stringed carriers into the rod. Moreover, it is frequently awkward and inconvenient to attach the draperies to the carriers on an installed rod. It has been found that the installation of the draperies can be markedly facilitated if the interconnected drapery carriers are first attached to the drapery heading and the interconnected carrier system thereafter inserted into the rod.

SUMMARY OF THE INVENTION

This invention relates to a traverse rod assembly utilizing an interconnected drapery carrier system in which the drapery carriers are interconnected by a flexible member.

An important object of this invention is to provide a traverse rod assembly utilizing an interconnected carrier system and having an improved arrangement which enables insertion of the interconnected carrier system into rod and connection of the end of the interconnected carrier system to the master carrier while the master carrier remains on the rod.

Another object of this invention is to provide a traverse rod with an interconnected carrier system in accordance with the foregoing object and which is arranged to detachably mount a carrier at one end of the string of auxiliary carriers on the master slide, while the master slide is mounted on the rod, so that the lead carrier functions to anchor and space the auxiliary carriers from the master carrier.

Still another object of this invention is to provide a traverse rod and interconnected carrier system in accordance with the foregoing object and in which the master carrier is constructed and arranged so that the lead carrier at one end of the string can be moved to a preselected position relative to the master drapery mounting means on the master carrier, while the master carrier is mounted on the rod, with clamp means for detachably clamping the lead carrier to the master carrier in that preselected position.

Still another object of this invention is to provide a traverse rod and interconnected drapery carrier system in which the lead end of the string of carriers is detachably clamped to the master carrier and in which the clamp for detachably clamping the string of carriers to the master carrier also functions as a guide and support for the master carrier on the auxiliary carrier channel.

These, together with other objects and advantages of this invention will be more readily understood by reference to the following detailed description, when taken in connection with the accompanying drawings wherein:

FIG. 1 is a fragmentary perspective view of a drapery installation utilizing the traverse rod and interconnected carrier system of the present invention;

FIG. 2 is a fragmentary bottom view of the drapery traverse rod assembly of FIG. 1;

FIG. 3 is a fragmentary longitudinal sectional view through the traverse rod assembly taken on the plane 3—3 of FIG. 2;

FIG. 4 is a transverse view through the traverse rod assembly taken on the plane 4—4 of FIG. 3;

FIG. 5 is an exploded perspective view illustrating the arrangement for attaching the lead end of the interconnected carrier system to the master slide;

Figure 6:
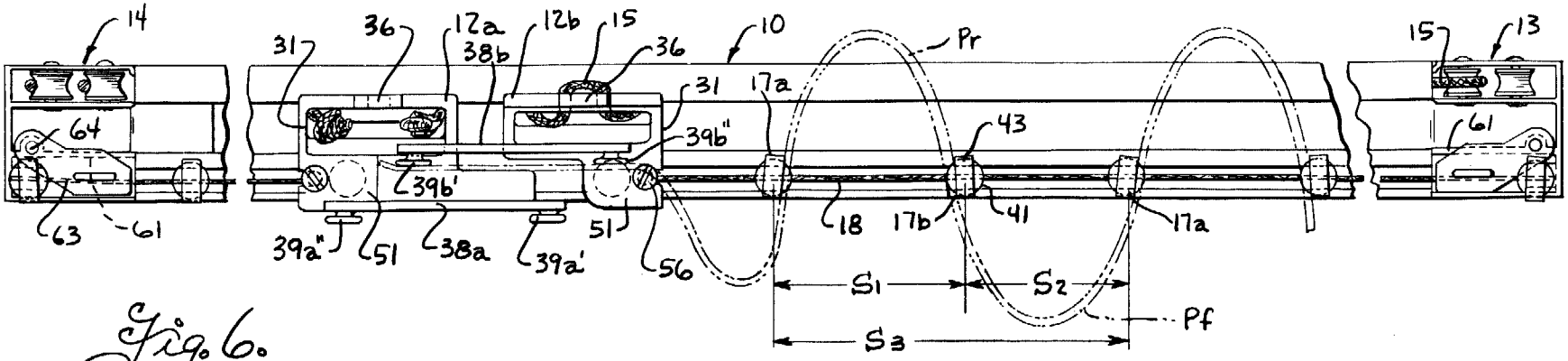
FIG. 6 is a bottom view illustrating a traverse rod assembly having a modified form of master slide.

The traverse rod assembly of the present invention is generally adapted for supporting draperies, curtains, and the like, hereinafter referred to as draperies. The traverse rod assembly includes an elongated rigid rod structure 10 having a downwardly opening carrier channel 11; one or more master carriers 12 guidably mounted on the rod structure for movement along a path paralleling the carrier channel; traverse cord guide means 13, 14 adjacent opposite ends of the rod, and traverse cords 15 extending over the cord guide means and lengthwise of the rod and connected to the master carriers to move the same along the rod. An interconnected drapery carrier system including a plurality of auxiliary carriers 17 attached at spaced locations along a flexible member 18 are guidably mounted in the carrier channel and a clamp means 19 is provided for detachably connecting one end of the drapery carrier system to the master carriers for movement thereby.

The configuration of the rod 10 is generally similar to that disclosed in the applicant's prior U.S. Pat. No. 3,693,696 and includes a generally flat top wall 21, a front wall 22, an intermediate wall 23 and a rear wall 24. The front and intermediate walls 22 and 23 define the downwardly opening channel 11 at the front of the rod and the front and intermediate walls have inwardly directed flanges 22*a*, 23*a* at their lower edges defining carrier guide rails that are spaced apart to provide a slot therebetween. The rear wall 24 has a forwardly extending bottom wall portion 25 on the lower edge of the rear wall defining a forwardly facing cord channel 26 along the rear of the rod. The bottom wall is adapted to underlie and support the traverse cords 15 along the length of the rod and the bottom wall is formed with an upwardly extending flange 25*a* at its forward edge to aid in retaining the traverse cords in the rear cord channel. The flange 25*a* at the forward edge of the bottom wall is spaced rearwardly a substantial distance from the intermediate wall 23 to provide downwardly opening access passageway in the rod between the rear cord channel and the front carrier channel and the intermediate wall 23 is provided with a rearwardly extending flange 23*b* long its lower edge for guiding the master carrier.

The master carriers 12 include a main body portion 31 disposed in the access passageway and having a forwardly opening groove 31*a* that guidably engages the flange 23*b* on the intermediate wall and a rearwardly opening groove 31*b* that guidably engages the flange 25*a* on the bottom wall. The base 31 of the master slide has rearwardly facing cord openings 33 to receive the traverse cord from the rear cord channel and a downwardly facing cord opening 34 intermediate the front and rear cord channels and which opens into a cord receiving recess 35 (FIG. 2) at the underside of the master carrier. Thus, the ends of the traverse cord can be drawn from the rear cord channel through the openings 33 and then through the downwardly facing opening 34 and knotted or otherwise secured to the master carrier at the underside of the latter. A cord lock 36 defining opposed cord receiving notches 36*a* (See FIG. 3) is provided at the rear edge of the master slide.

Figure 7:
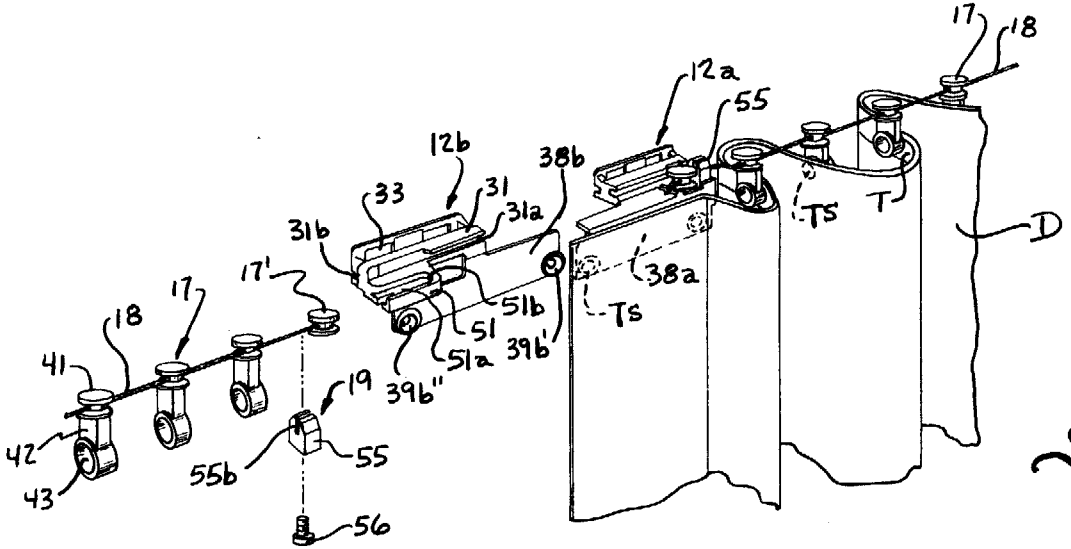
FIG. 7 is a fragmentary exploded perspective view of the master carriers and interconnected drapery carrier system shown in FIG. 6.

In the embodiment of FIGS. 1–5, the master slides are of the so-called butt type and have a drapery support arm 38 disposed crosswise of the rod, with first and second master drapery mounting means 39' and 39'' thereon. In the embodiment of FIGS. 6 and 7, the master carriers are of the so-called overlap type and one master carrier designated 12*a* has an overlap arm 38*a* extending longitudinally of the rod adjacent the front sides thereof and the other master carrier 12*b* has an underlap arm 38*b* that also extends longitudinally of the rod and is offset rearwardly from the front side of the rod. The overlap arm 38*a* has first and second master drapery mounting means 39*a'* and 39*a''* thereon and the underlap arm 38*b* has first and second master drapery mounting means 39*b'* and 39*b''* spaced apart longitudinally of the rod.

The auxiliary drapery carriers 17 of the interconnected drapery carrier system are preferably molded of plastic at spaced locations along the flexible member 18 and each have a head 41 that guidably engages the rails 22*a*, 23*a* on the carrier channel and a pendant 42 that extends downwardly from the head and an auxiliary drapery mounting means 43 on the lower end of the pendant. The heads 41 of the drapery carriers include an upper head portion 41*a* that is wider than the space between the guide rails 22*a*, 23*a*; a neck portion 41*b* that extends downwardly between the rails and a lower head portion 41*c* that is also wider than the space between the rails and which underlies the same to guidably maintain the heads on the rails. The heads 41 are preferably of circular cross section to allow limited turning or rotation of the carriers about an upright axis and, as best shown in FIG. 3, the adjacent faces of the upper and lower head portions are preferably generally semi-spherical to allow limited angular movement of the carriers in a direction crosswise of the channel.

The auxiliary drapery carriers 17 are attached to a drapery designated by a D at spaced locations along the heading or upper edge of the drapery. One known method of attaching the draperies to the carriers includes a tape designated by the letter T (FIG. 7) which is sewn or otherwise attached to the upper edge of the draperies and which has snap fasteners Ts at uniformily spaced locations therealong adapted to interfit with the drapery mounting means 43 on the auxiliary drapery carrier pendants. Other snap fasteners are provided adjacent the lead edge of the drapery for engagement with the master carrier mounting means on the master carriers. The tapes can be made with different spacing of the snaps therealong to provide plates or folds in the drapery of different depths and the spacing of the snaps adjacent the lead edge of the drapery are of course selected to correspond to the spacing of the master drapery mounting means on the master carrier. Another known system of attaching draperies uses individual sew-on pleater members. The sew-on pleater members include one or more snaps adapted to interfit with the drapery mounting means 43 and mounted on a base which can be sewn onto the drapery at the desired spaced locations along the drapery heading. The auxiliary drapery carriers 17 are spaced along the flexible element 18 at a distance less than the spacing of drapery carriers along the drapery heading so that the cord element holds the drapery in generally uniform pleats or folds when the drapery is closed. As will be seen from FIG. 6 of the drawings, the rearwardly extending portion of a drapery pleat designated $P_r$ is disposed between adjacent carriers while the forwardly extending portion of the drapery pleat designated $P_f$ is disposed on the outer side of adjacent carriers. Alternate ones of the auxiliary carriers designated 17*a* are spaced apart a uniform distance along the string 18, indicated by the distance $S_3$ in FIG. 6, and the intermediate drapery carriers 17*b* are offset slightly from a position equidistant from the adjacent carriers 17*a* to substantially equalize the length measured along the rod of the rearwardly extending pleat portion $P_r$ with the forwardly extending pleat portion $P_f$. Stated otherwise, the distance $S_1$ between the intermediate auxiliary carrier 17*b* and one of the adjacent auxiliary carriers 17*a* is slightly greater than one-half the distance $S_3$ and the distance $S_2$ between the auxiliary carrier 17*b* and the next adjacent auxiliary carrier 17*a* is slightly less than one-half the distance $S_3$.

The distance $S_3$ between alternate auxiliary drapery carriers measured along the rod determines the effective length along the rod of a complete drapery pleat consisting of a rear portion $P_r$ and an adjacent front portion $P_f$. The interconnected drapery carrier systems are available with the carriers arranged at different lead distance $S_3$ to provide draperies of different fullness when the draperies are closed. The selection of the lead length of the interconnected drapery carrier system is dependent upon a number of factors including the spacing of the snap fasteners on the tape T, the type of drapery material used, the fullness desired and the like. It is accordingly frequently desirable to delay the final selection of the lead of the interconnected drapery carrier system to be used until after the rod has been installed. It is also sometimes desirable to change the interconnected drapery carrier system to either replace a worn system or to substitute a system having a different carrier lead. The traverse rod is accordingly arranged so that the interconnected drapery carrier system can be installed in the carrier channel on the rod and connected to the master carrier after the traverse rod has been installed and without requiring removal of the rod from its mounting or removal of the master slides from the rod. One of the carriers designated 17' at the lead end of the interconnected carrier system is utilized in attaching the drapery carrier system to the master slide and to space the next succeeding auxiliary carrier in proper relation to the master drapery mounting means on the master carrier. Although the entire carrier at the lead end of the string could be utilized, it is preferred to cut off the pendant portion of the lead carrier and to utilize only the head on the lead carrier. The master carriers are formed with a lead carrier attaching portion 51 that underlies the carrier channel 11 and which has an upper face portion 51*a* spaced below the channel a distance sufficient to allow sliding of a lead carrier 17' into a position over the mounting portion 51 into preselected position relative to the master drapery mounting means on the lead carrier. As previously described, the master carriers each have two master drapery mounting means, the first one designated by the postscript ' for attachment adjacent the lead edge of the drape and the second one designated by the postscript '' for attachment inwardly of the lead edge of the drape. The lead carrier 17' is advantageously made movable along the guide rails relative to the master slide to a position in which the lead carrier 17' is closely adjacent a plane extending through the second master drapery mounting means and traverse to the rod. Thus, as best shown in FIG. 2, the lead carrier 17' is movable along the guide rails relative to the master carrier to a position closely adjacent the master drapery mounting 39''. In the embodiment in FIG. 6, the lead carrier 17' is movable along the guide rail and relative to the overlap master carrier 12*a* having the overlap arm 38*a* to a position approximately aligned in a direction crosswise of the rod with the second master drapery mounting 39*a''*. Similarly, the lead carrier on the other interconnected drapery system is movable along the guide rails relative to the master carrier 12*b* having the underlap arm 38*b* to a position in which it is approximately aligned in a direction transverse to the rod with the second master drapery mounting means 39*b''* on the underlap arm. The auxiliary carrier mounting portion 51 is formed with a stop shoulder 51*b* arranged to engage the lead carrier and limit movement of the same in one direction relative to the master carrier and a clamp member 55 is provided to engage the master carrier and the lead carrier 17' at a location intermediate the lead carrier and the next adjacent carrier to lock the lead carrier to the master carrier. In the preferred embodiment illustrated, the clamp means is also arranged to provide a supplemental support for the master carrier on the front carrier channel and the clamp member comprises a body of plastic or the like wider than the space between the rails 22*a* and 23*a* and having grooves 55*a* in opposite side edges arranged to guidably engage the rails to slidably support the clamp member from movement therealong. The clamp member has a depth measured below the grooves 55*a* generally corresponding to the depth of the lower head portion 41*c* on the slides 17 so that it can also move along the guide rails into overlying relation with the portion 51 of the master slide. A fastener means 56 is provided to lock the clamp member to the master slide. The fastener 56 is conveniently threaded into the underside of the clamp member 55 and the mounting portion 51 of the master carrier is formed with a notch 51*c* for receiving the shank of the fastener 56. The clamp member with the fastener 56 in a loosened condition can thus be moved along the guide rails into position on the mounting portion 51 and the fastener thereafter tightened to secure the clamp member in position. The underside of the mounting portion is preferably recessed around the inner end of the slot to receive the head of the fastener 56 to aid in holding the same in position. The clamp member 55 is also advantageously notched as indicated at 55*b* at its upper side to receive the portion of the flexible member 18 intermediate the lead carrier and next succeeding carrier. The notch is preferably keyhole shaped to provide an opening at its inner end sufficiently large to slidably receive the cord while the outer end of the notch is sufficiently tight to restrict passage of the cord therethrough. In this manner, the clamp member can be attached to the cord before assembly of the interconnected drapery system on the rod.

The rod 10 is provided with gates at the end of the carrier channel to allow insertion and removal of the carriers from the end of the rod. The gates are conveniently formed in the end pulley housings 13, 14 and, as best shown in FIGS. 2 and 6, the pulley housings are formed with a downwardly facing opening 61 aligned with the end of the rails 22*a*, 23*a* which is sufficiently wide to allow passage of the heads of the carriers 17 therethrough. The pulley housing is also formed with flange portions 62*a* and 62*b* which are spaced apart a distance corresponding to the spacing of the rails 22*a*, 23*a* to receive the head of the carrier 17 therein, as shown in FIG. 6, to support the same. A gate member 63 is mounted as on a pivot 64 for movement to an open position shown in FIG. 2 uncovering the ends of the rails 22*a*, 23*a* and a closed position as shown in FIG. 6, blocking movement of the carriers out of the rails. As will be seen from FIG. 6, the gate, when closed, holds the end carrier on the interconnected carrier system against movement along the rod.

From the foregoing it is felt that the construction and use of the traverse rod assembly will be readily understood. The master slide can be mounted on the rod and connected to the traverse cords before the rod is installed. The interconnected carrier assembly can be mounted and removed from the rod and connected and disconnected from the master carrier while the rod is installed and while the master carriers are on the rod. This not only enables selection and installation of the desired interconnected carrier system on the rod after installation of the rod, but also allows mounting of the drapery carrier system in the rod after it has been attached to the drapery heading. Since the overhead clearance is very small when the drapery rods are installed, attachment of the interconnected drapery carrier system to the drapery heading before the carrier system is mounted on the rod, markedly facilitates installation. The lead carrier and the other auxiliary carriers are serially inserted through the gate at the end of the carrier rails and the lead carrier is moved along the rails into proper relation to the master carrier and then clamped to the master carrier by the clamp member 19. Since the lead carrier is molded on the string with the auxiliary carriers, it provides a firm anchor for the lead end of the string and, moreover, assures proper spacing of the auxiliary carriers relative to the master drapery mounting means on the master carrier. In addition, the clamp means is conveniently guidably mounted on the rail and, when attached to the master carrier, provides a supplemental guide for the master carrier in the carrier channel.

The embodiments of the invention in which an exclusive property or privilege is claimed are defined as follows:

1. A traverse rod assembly for draperies and the like including an elongated rigid rod structure having a downwardly opening carrier channel with inwardly directed flanges along the lower edge of the channel defining spaced carrier guide rails, at least one master carrier having means guidably mounting the same on the rod structure for movement therealong parallel to said carrier channel, said master carrier having at least one master drapery mounting means thereon, traverse cord guide means adjacent opposite ends of the rod, traverse cord means entrained over the traverse cord guide means and connected to the master carrier for moving the same along the rod structure, a string of carriers including a lead carrier at one end of an elongated flexible member and a plurality of auxiliary drapery carriers at preselected spaced locations along the flexible member, the lead and auxiliary carriers each including a rail engaging head shaped to guidably engage said carrier rails and having an upper head portion inside the channel and wider than the space between the guide rails; a neck portion extending downwardly between the guide rails; and a lower head portion wider than the space between the rails and underlying the same, at least the auxiliary drapery carrier having a pendant portion below the channel and auxiliary drapery mounting means on the pendant portion, the rod structure having carrier gate means adjacent at least one end of said guide rails to allow insertion and removal of the rail engaging heads on the lead and auxiliary carriers from the guide rails, said master carrier being constructed and arranged to allow sliding of the lead carrier along the guide rails into a preselected position relative to the master drapery mounting means on the master carrier while the latter is mounted on the rod, and clamp means engageable with the lead carrier and the master carrier when the lead carrier is moved along the guide rails to said preselected position relative to the master drapery mounting means for detachably securing the lead carrier to the master carrier for movement with the latter.

2. A traverse rod according to claim 1 wherein said lead carrier, when in said preselected position, is closely adjacent a plane extending through said one master drapery mounting means and traverse to the rod assembly.

3. A traverse rod according to claim 1 wherein said master carrier has a lead carrier mounting portion underlying said front channel, said lead carrier being movable along said guide rails into overlying relation to said lead carrier mounting portion of the master carrier.

4. A traverse rod according to claim 1 wherein said master carrier has a lead carrier mounting portion underlying said front channel, said lead carrier being movable along said guide rails into overlying relation to said lead carrier mounting portion of the master carrier, and said clamp means comprising a clamp member removably mounted on said lead carrier mounting portion of the master carrier at a location to engage and hold said lead carrier in said preselected position.

5. A traverse rod according to claim 1 wherein said clamp means comprises a clamp member wider than the space between the guide rails and having opposed grooves for slidably receiving said guide rails, and means for detachably securing said clamp member to said master slide when said lead carrier is in said preselected position.

6. A traverse rod according to claim 5 wherein said clamp member has a groove therein for receiving said flexible member.

7. A traverse rod according to claim 1 wherein said master carrier has a lead carrier mounting portion underlying said carrier channel, said lead carrier being movable along said guide rails into overlying relation to said lead carrier mounting portion of the master carrier into said preselected position, said clamp means comprising a clamp member wider than the space between the guide rails and having opposed grooves for slidably receiving said guide rails, and means for detachably securing said clamp member to said lead carrier mounting portion of said master slide at a location to engage and hold said lead carrier in said preselected position.

8. A traverse rod according to claim 7 wherein said clamp member has a groove therein for receiving said flexible member.

9. A traverse rod according to claim 7 wherein said clamp member is slidable along said guide rails into overlying relation to said lead carrier mounting portion of said master carrier at the trail side of said lead carrier when the latter is in said preselected position, and fastener means for detachably securing said clamp member to said lead carrier mounting portion of said master carrier.

10. A traverse rod according to claim 9 wherein said clamp member has a groove therein for receiving said flexible member.

* * * * *